United States Patent [19]

Karabin

[11] Patent Number: 5,052,370

[45] Date of Patent: Oct. 1, 1991

[54] GAS BURNER ASSEMBLY INCLUDING EMBERIZING MATERIAL

[75] Inventor: Tadeusz Karabin, Huntington, Ind.

[73] Assignee: Majco Building Specialties, L.P., Huntington, Ind.

[21] Appl. No.: 668,031

[22] Filed: Mar. 12, 1991

[51] Int. Cl.[5] ..... F24C 3/00

[52] U.S. Cl. ..... 126/512; 126/92 R

[58] Field of Search ..... 431/125; 126/512, 92 R

[56] References Cited

U.S. PATENT DOCUMENTS

| | | | |
|---|---|---|---|
| 3,583,845 | 6/1971 | Pulone | 126/512 |
| 4,828,485 | 5/1989 | Jankowski . | |
| 4,890,601 | 1/1990 | Potter . | |
| 4,940,407 | 7/1990 | Rehberg et al. . | |
| 4,976,253 | 12/1990 | Beal et al. | 126/92 R |

*Primary Examiner*—Carroll B. Dority

*Attorney, Agent, or Firm*—Hoffmann & Baron

[57] ABSTRACT

An assembly is disclosed for enhancing the aesthetics of a gas fireplace. The assembly includes an elongated burner tube which is laterally disposed within the combustion chamber of the fireplace and which includes discharge ports which are inwardly oriented with respect to the combustion chamber. A tray adjoins the front side of the burner tube and may support lava rocks or the like for hiding the burner tube from view. A gap is defined between the floor of the combustion chamber and the bottom surface of the tray so that secondary air can travel from the front end of the combustion chamber towards the burner tube. A support adjoins the rear side of the burner tube and includes an inclined surface facing the burner tube. An emberizing material such as mineral wool is supported by the inclined surfaces. Ignition of the burner tube causes flames to be directed rearwardly and to impinge upon the emberizing material, causing it to glow. The orientation of the emberizing material with respect to the combustion chamber provides a large glowing surface. The burner tube and support are both adapted to be secured to a grate which is used for supporting an artificial log set.

18 Claims, 6 Drawing Sheets

GAS BURNER ASSEMBLY INCLUDING EMBERIZING MATERIAL

BACKGROUND OF THE INVENTION

1. Field of the Invention

The field of the invention relates to gas burners and gas burning fireplaces including means for enhancing the aesthetic effects of the flames produced thereby.

2. Brief Description of the Related Art

Gas burning fireplaces are now commonly used in lieu of natural wood burning fireplaces. They are much easier to start, require almost no cleaning, and can be constructed so as to operate in an environmentally sound manner.

The generation of a natural looking fire in a gas fireplace is almost always one of the paramount objectives. For example, yellow flames are preferred over unnatural looking blue flames. U.S. Pat. No. 4,976,253 discloses a gas fireplace which is capable of producing such yellow flames.

In addition to the flames themselves, the areas of a gas fireplace beneath and surrounding the artificial log sets used therein must also appear to be natural. Several approaches have been taken for producing the effects of glowing embers adjacent to the log sets. U.S. Pat. Nos. 4,828,485, 4,890,601 and 4,940,407 disclose the use of rock wool in conjunction with gas burners for producing such effects. As discussed in U.S. Pat. No. 4,940,407, the rock wool may be doped to convert the blue coloration of a gas flame to a more natural yellow-orange color. Mineral wool has also been placed over steel wire mesh and directly on the gas burner in attempts to produce a glowing effect.

SUMMARY OF THE INVENTION

It is an object of the invention to provide a gas burner assembly which, when used in conjunction with an artificial log set, provides the appearance of a natural wood fire.

It is another object of the invention to provide such an assembly which is easily constructed and easily positioned within the combustion chamber of a fireplace.

A still further object of the invention is to provide a fireplace assembly which includes a gas burner assembly and an artificial log set positioned within a combustion chamber, and including means for generating a fire which closely resembles a natural wood fire.

In accordance with these and other objects of the invention, an assembly is provided which includes a burner tube, a tray adjoining one side of the burner tube, and a support including an inclined surface adjoining the opposite side of the burner tube. The burner tube includes a plurality of discharge ports oriented towards the inclined surface. Mineral wool placed upon the inclined surface provides a relatively large, glowing surface when the burner tube is operated. The assembly is preferably installed in a fireplace such that the inclined surface faces the front of the fireplace, thereby allowing the glowing mineral wool to easily be seen. The tray is adapted for supporting lava rocks or the like. It also provides a gap between the bottom surface thereof and the floor of the fireplace in which it is installed. Secondary combustion air may be drawn through the gap to the burner tube.

A gas fireplace is also provided in accordance with the invention. The fireplace includes a combustion chamber within which an assembly as described above is positioned for enhancing the aesthetics thereof. A grate is positioned within the combustion chamber. An artificial log set is supported by the grate. The burner tube and support are both secured to the grate. A main burner assembly may also be supported by the grate. The main burner assembly provides the flames which extend about and through the artificial log set.

DETAILED DESCRIPTION OF THE INVENTION

Figure 1:
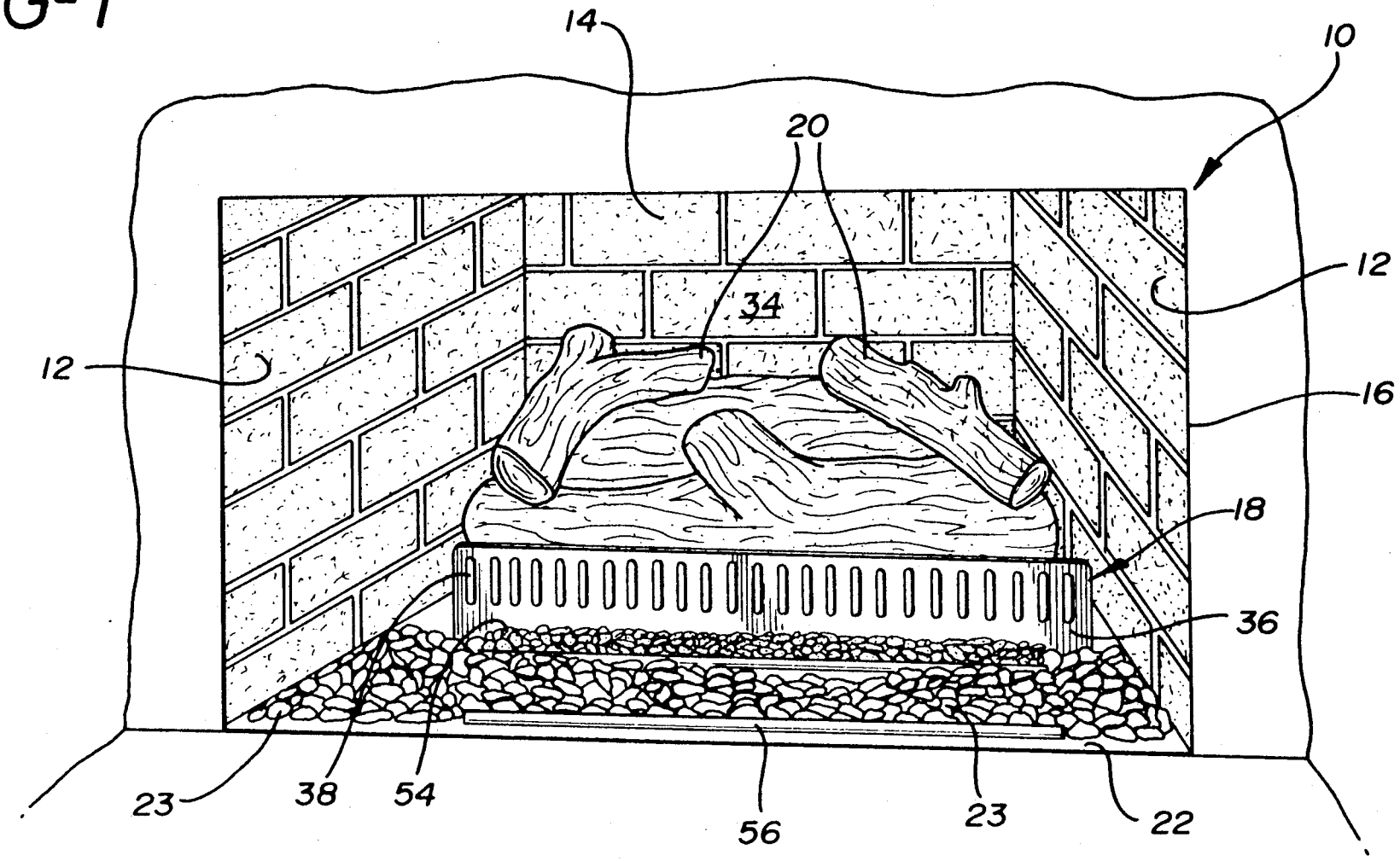
FIG. 1 is a front perspective view of a fireplace assembly according to the invention.
Figure 2:
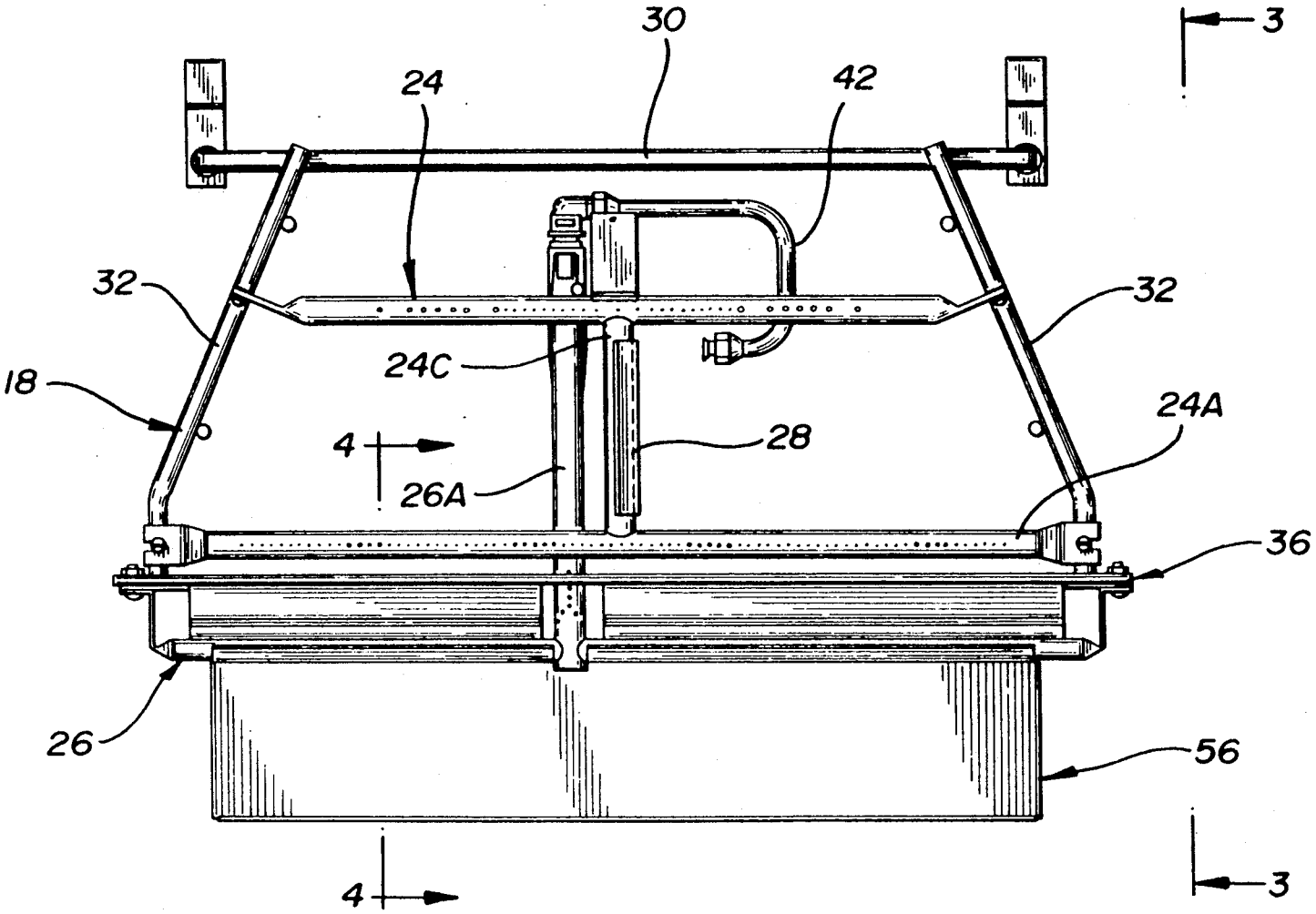
FIG. 2 is a top plan view of a burner assembly according to the invention in conjunction with a grate and main burner assembly.
Figure 3:
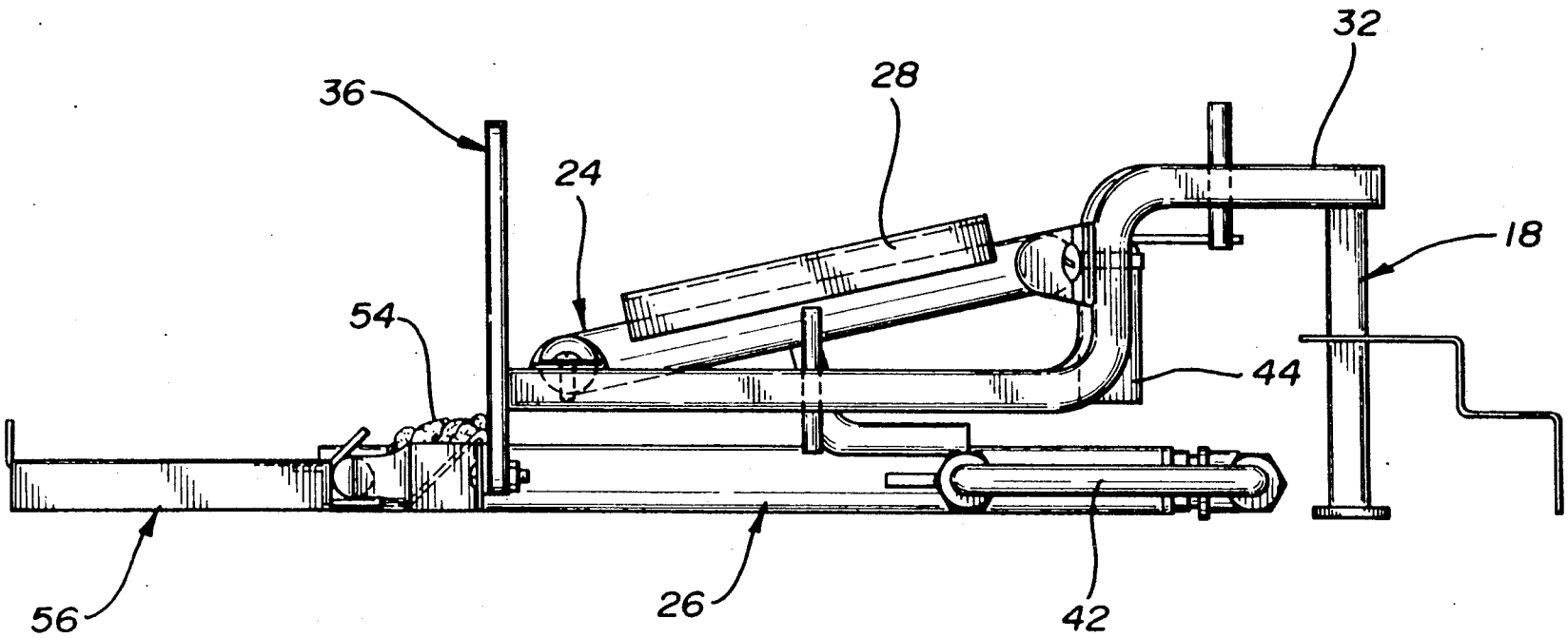
FIG. 3 is a side elevation view thereof.

A fireplace assembly 10 including vertical side walls 12, a rear wall 14, a front opening 16, a grate 18, and an artificial log set 20 is shown in FIG. 1. The floor 22 of the fireplace supports the grate 18 and a plurality of lava rocks 23 or the like. The assembly 10 is designed to provide a realistic appearance whether in use or not.

Referring to FIGS. 2–6, a main gas burner assembly 24 and a second gas burner assembly 26 are mounted to the grate 18. The main gas burner includes a pair of parallel burner tubes 24A, 24B which are connected near their respective midpoints by a third burner tube 24C. Such a burner is disclosed in U.S. Pat. No. 4,976,253. The burner 24 is arranged with respect to the log set 20 such that flames are produced towards the front of the log set by the front burner tube 24A and between the logs of the log set by the rear burner tube 24B. The discharge ports of the third burner tube 24C are covered by a shield 28.

The grate 18 includes a rear support 30 and a pair of forwardly diverging braces 32 secured thereto. It is positioned upon the floor 22 of the combustion chamber 34 of the fireplace assembly such that the front and rear burner tubes 24A, 24B are substantially parallel to the front opening 16. The grate may include an elongated front plate 36 having a row of slotted openings 38 formed therein. The bottom of the plate 36 includes a pair of recesses 40 for admitting air to the region beneath the burner tubes 24A, 24B, 24C.

The second gas burner assembly 26 includes a first burner tube 26A which extends towards the front opening 16 of the fireplace and a second burner tube 26B which is joined thereto. The assembly accordingly has a generally "T-shaped" configuration. The second burner tube may actually be comprised of a pair of tubes, each of which is in fluid communication with the first burner tube 26A. One of the pair of tubes is shorter than the other so that the first burner tube 26A of the second gas burner assembly does not interfere with the third burner tube 24C of the main burner assembly when assembled to the grate 18. The burner assemblies may be constructed differently if assembled to different types of grates or with burner assemblies having different configurations.

A generally U-shaped inlet tube 42 is joined to the first burner tube 26A. This tube may be connected to a gas source (not shown) which supplies one or both burner assemblies. Ignition means 44 are provided for igniting the gas within the main burner assembly 24, either electrically or manually. The gas flowing from the discharge ports of the second burner assembly 26 is ignited upon ignition of the main burner assembly. Gas is supplied to the main burner assembly 24 at the midpoint of the bottom surface of the third tube 24C.

Figure 5:
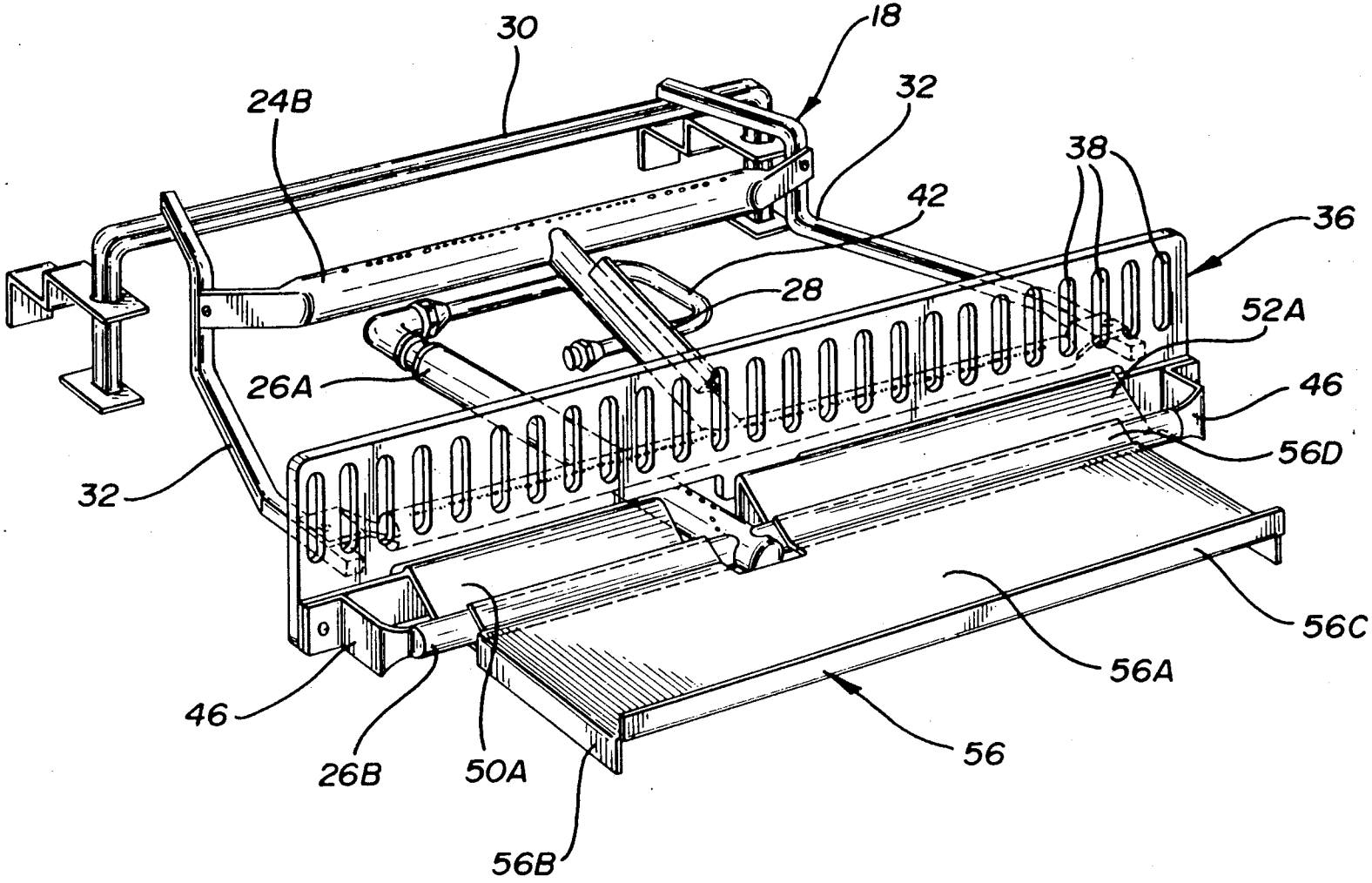
FIG. 5 is a top perspective view of the assembly shown in FIG. 2.
Figure 6:
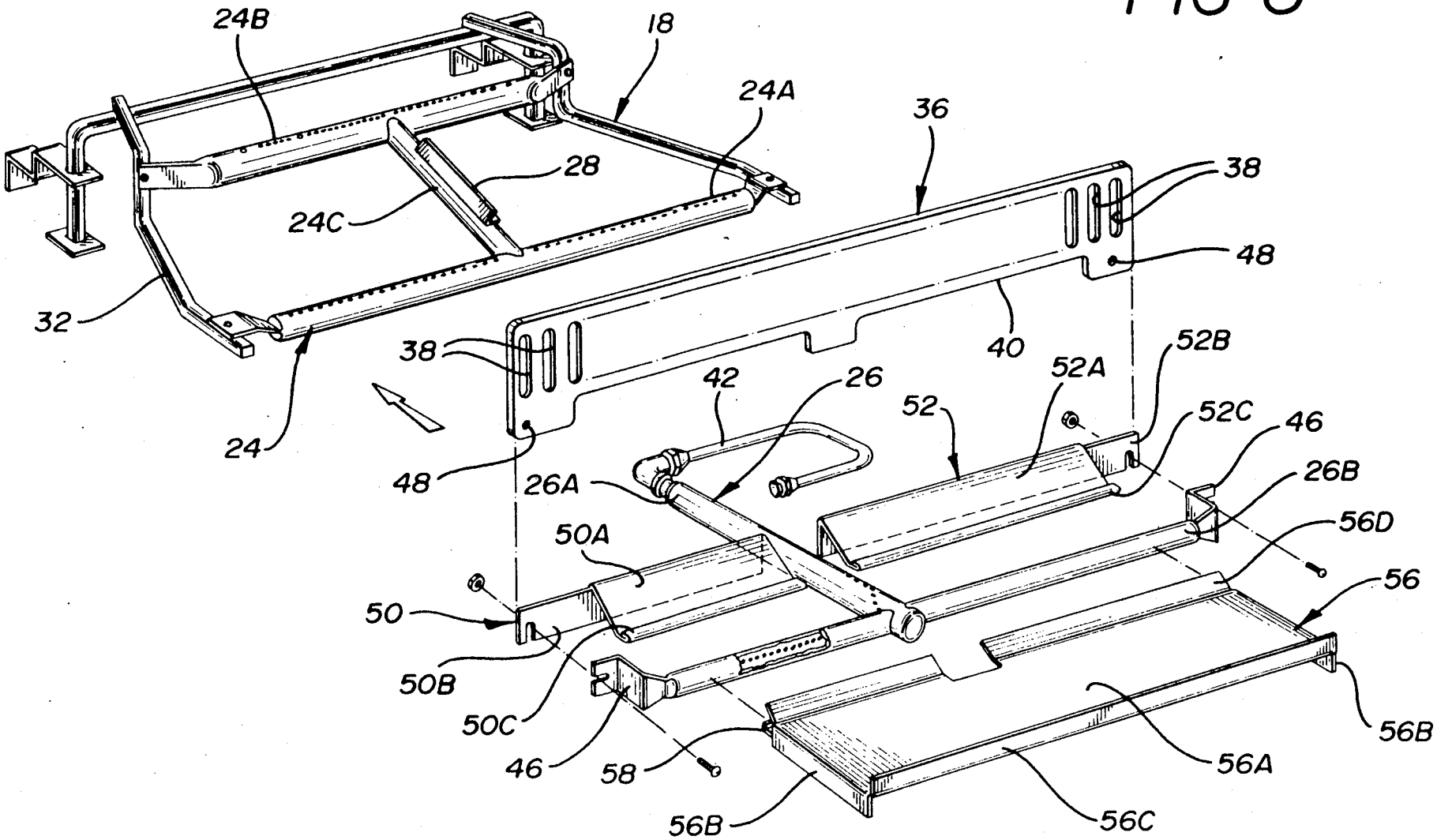
FIG. 6 is an exploded, top perspective thereof.

As best shown in FIGS. 5 and 6, each end of the burner tube 26B is closed. An L-shaped bracket 46 is formed at each of these ends, and includes a notch through which a screw can be inserted. The notches can be aligned with a pair of threaded openings 48 in the plate 36. The brackets create a space between the plate 36 and the burner tube 26B.

A pair of supports 50, 52 are positioned in the space between the plate 36 and the burner tube 26B. Each support includes an inclined wall 50A, 52A which is capable of supporting a covering of emberizing material such as mineral wool 54. (See FIG. 4). The supports further include vertical walls 50B, 52B which are integral with the respective inclined walls 50A, 52A. Each vertical wall includes a notched end portion which can be aligned with the notched brackets 46 and the openings 48 in the grate plate 36. A pair of integral, horizontal walls 50C, 52C extend, respectively, from the lower ends of the inclined walls 50A, 52A. Neither the vertical walls nor the horizontal walls of the respective supports completely blocks the elongate openings defined by the recesses 40 when the supports are secured to the plate 36. The flow of air from beneath the plate 36 to the main burner assembly 26 accordingly is not completely impeded.

A tray 56 is positioned in adjoining relation to the burner tube 26B. The tray includes a horizontal portion including a substantially flat, horizontal surface 56A which is supported by a pair of vertical walls 56B. A flow channel is accordingly defined by the floor 22 of the fireplace assembly, the horizontal portion of the tray, and the pair of opposing vertical walls 56B when the tray is placed on the floor of the combustion chamber.

Figure 4:
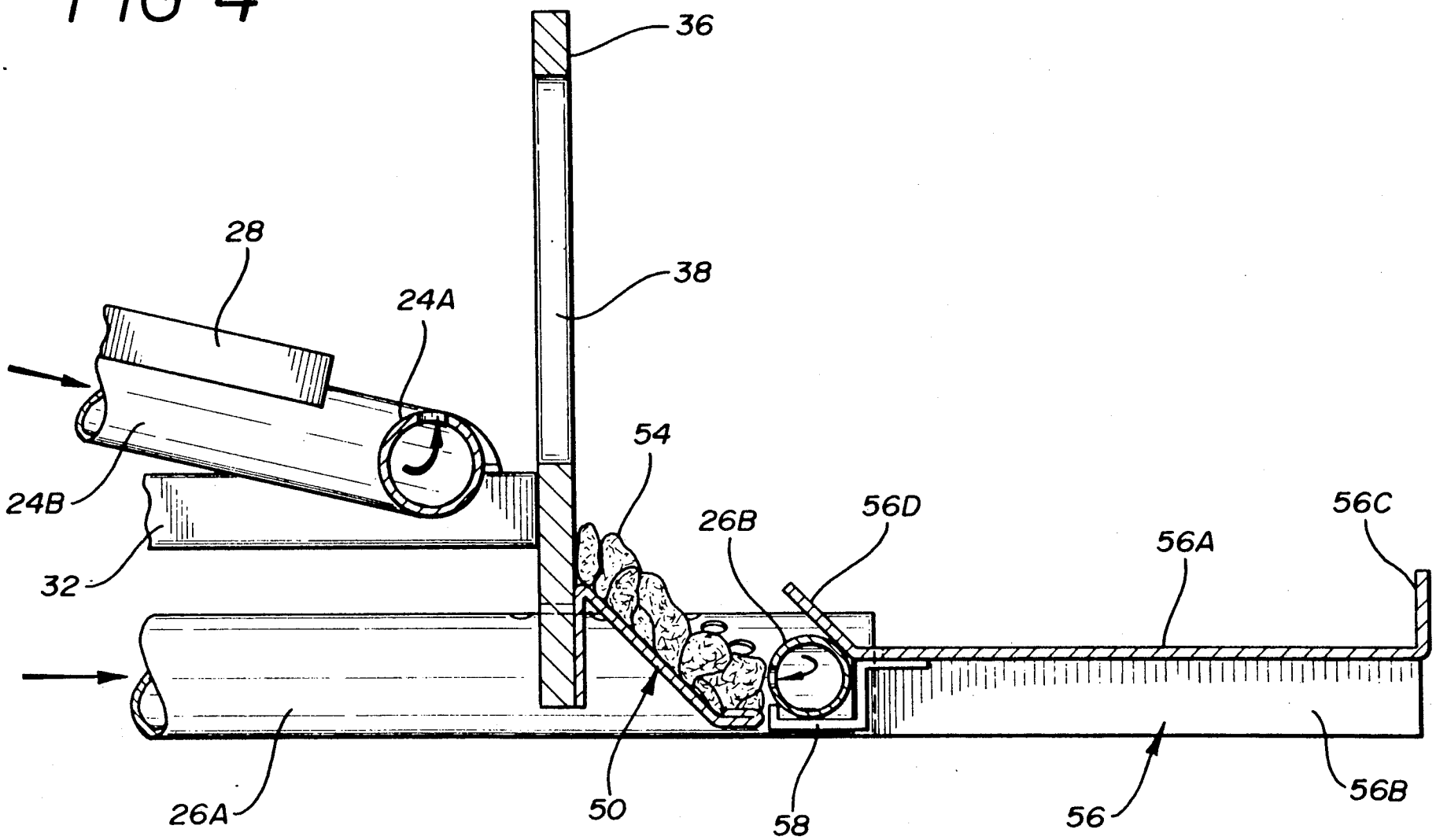
FIG. 4 is a partially sectional, elevation view of the front portion of the assembly shown in FIG. 3.

A vertically extending front wall 56C formed integrally with the tray 56 defines the front end of the tray. The rear end thereof includes a rearwardly inclined wall 56D. A pair of brackets 58 are secured to the bottom surface of the tray. Each bracket includes a substantially horizontal portion 58A which is located beneath and in opposing relation to the inclined wall 56D. As shown in FIG. 4, the laterally extending burner tube 26B of the second burner assembly is supported by the horizontal portions 58A of the brackets 58. Most of this tube is positioned beneath the inclined wall 56D, which protects it from drafts.

The burner tube 26B includes a plurality of discharge ports which are oriented upwardly towards the mineral wool 54 at about a thirty degree angle from the vertical plane. The discharge ports of the main burner tubes 24A, 24B are oriented substantially vertically.

In operation, the main burner assembly provides two walls of flames, one from each of the laterally extending burner tubes 24A, 24B. These flames are formed in front of and in the middle of the log set 20. Air is not premixed with the gas flowing through the main burner assembly.

In a preferred embodiment of the invention, gas is injected under about 3.5 inches w.c. (water column) pressure through a 0.059 inch diameter orifice which pulls air into the second burner assembly 26. The mixture is introduced into the first burner tube 26A thereof from where it spreads into the left and right transversely extending tubes which comprise the second burner tube 26B. Ignition of the main burner assembly 24 causes the ignition of the second burner assembly 26 as flames spread therefrom to the discharge ports in the front end of the first burner tube 26A and/or those within the second burner tube 26B.

As discussed above, the discharge ports within the transversely extending tube 26B are oriented towards the inside of the fireplace assembly. They may also have diameters of about 0.042 inches. Secondary air is supplied through the gap between the floor 22 and the tray 56, and flows under this burner tube 26B and along the flame jets. Sufficient premix and the supply of secondary air creates a stream of a very clean-combustible gases, which are discharged directly upon the surface of the mineral wood 54. Because of the flow pattern provided, and the relatively hot temperature of the flue gases, which is sustained due to a lack of cooling air as well as slow heat dissipation in the area of the second burner tube 26B and mineral wool 54, the glowing surface area is relatively large both in height and width. In addition, because the glowing surface is oriented towards the viewer, the glowing surface appears to be even larger. The parallel flow of secondary air further enhances the glowing appearance which is provided.

The second burner assembly and associated supports and tray can be installed separately for use with gas logs or as part of the burner assembly of a conventional gas fireplace. The various components may be configured differently for adaptation to various fireplaces, log sets, and/or burner assemblies. This mineral wool 54 may be crimped to the respective supports 50, 52 or secured in an alternative manner. For example, the wool may be adhered to a pair of V-shaped members by a non-combustible adhesive. The V-shaped members are then secured mechanically or by an adhesive to the respective supports.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An assembly for enhancing the aesthetics of a gas fireplace comprising:

an elongated burner tube including a plurality of discharge ports;

a tray having a rear end and a front end, the rear end of said tray including a rear wall adjoining one side of said burner tube, said tray supporting a plurality of lava rocks; and a support independently of said tray adjoining the opposite side of said burner tube, said support including an inclined surface adapted for supporting mineral wool or the like, the discharge ports of said burner tube being oriented generally towards the inclined surface of said support.

2. An assembly as described in claim 1 wherein said inclined surface is substantially coextensive with the length of said burner tube.

3. An assembly as described in claim 2 including mineral wool emberizing material positioned upon said inclined surface, said mineral wool being substantially coextensive with the length of said burner tube.

4. An assembly as described in claim 1 wherein said tray includes a top wall and a pair of legs for supporting said top wall.

5. An assembly as described in claim 1 wherein said rear wall of said tray is an inclined wall extending over at least a portion of said burner tube.

6. An assembly as described in claim 1 wherein said burner tube includes a pair of laterally extending flanges extending from the respective ends thereof, and said support includes a pair of laterally extending flanges adjoining the laterally extending flanges of the burner tube.

7. An assembly for enhancing the aesthetics of a gas fireplace, comprising:

a burner tube assembly including a first tube and a second tube, said second tube including a pair of closed ends and a plurality of discharge ports, said first tube adjoining said second tube between said pair of closed ends;

a first support including an inclined surface;

a second support including an inclined surface;

said first and second supports being securable to said second tube such that the respective inclined surfaces of said supports adjoin said second tube in generally opposing relation to the discharge ports thereof; and a quantity of emberizing material sufficient to substantially cover said inclined surfaces of said first and second supports.

8. An assembly as described in claim 7 including a tray, said tray including an inclined rear wall, said second burner tube being positionable at least partially beneath said inclined wall.

9. An assembly as described in claim 7 including a tray, said tray including a top wall and a pair of side walls for supporting said top wall, said tray having a width which generally corresponds to the length of said second tube, said tray being positionable adjacent to said second burner tube, and including means for at least partially occluding said second burner tube when positioned adjacent thereto.

10. An assembly as described in claim 9 wherein said tray includes means for supporting said second burner tube.

11. A fireplace assembly comprising:

a combustion chamber defined by a plurality of vertical walls and a floor adjoining the respective vertical walls;

an elongated burner tube positioned within said combustion chamber, said burner tube including a plurality of discharge ports;

a support including an inclined surface, said inclined surface adjoining said burner tube and extending above said burner tube, said inclined surface being positioned behind said burner tube and in generally opposing relation to a plurality of said discharge ports;

an emberizing material supported by said inclined surface, said emberizing material being capable of glowing when subjected to flames from said discharge ports;

a tray supported by the floor of the combustion chamber, said tray including a front end and a rear end, the rear end of said tray including a rear wall adjoining said burner tube, and spacing means extending from said tray to form a gap defined between said tray and the floor of said combustion chamber, said burner tube being in fluid communication with said gap.

12. A fireplace assembly as described in claim 11 wherein said inclined surface of said support is substantially coextensive with said burner tube.

13. A fireplace assembly as described in claim 11 wherein the rear wall extends at least partially over said burner tube.

14. A fireplace assembly as described in claim 11 including a grate, said burner tube and said support being secured to a front portion of said grate.

15. A fireplace assembly as described in claim 14 including an artificial log set supported by said grate and a main burner assembly supported by said grate, said main burner assembly being positioned beneath said log set.

16. A fireplace assembly as described in claim 15 including a plurality of lava rocks supported by said tray.

17. A fireplace assembly as described in claim 12 wherein said combustion chamber includes a front opening, said inclined surface of said support facing said front opening, said emberizing material substantially covering said inclined surface.

18. A fireplace assembly as described in claim 17 wherein the discharge ports of said burner tube are directed inwardly with respect to the front opening of the combustion chamber, said discharge ports being spaced a selected distance from said emberizing material and oriented generally towards said emberizing material.

* * * * *